US007528560B2

(12) United States Patent
Bae et al.

(10) Patent No.: US 7,528,560 B2
(45) Date of Patent: May 5, 2009

(54) DRIVING CONTROLLING APPARATUS OF LINEAR COMPRESSOR AND METHOD THEREOF

(75) Inventors: Gyoo-Jong Bae, Gyeongsangnam-do (KR); Dong-Hee Shin, Busan (KR)

(73) Assignee: LG Electronics Inc., Seoul (KR)

( * ) Notice: Subject to any disclaimer, the term of this patent is extended or adjusted under 35 U.S.C. 154(b) by 368 days.

(21) Appl. No.: 10/578,685

(22) PCT Filed: Nov. 11, 2003

(86) PCT No.: PCT/KR03/02419

§ 371 (c)(1),
(2), (4) Date: May 9, 2006

(87) PCT Pub. No.: WO2005/045248

PCT Pub. Date: May 19, 2005

(65) Prior Publication Data

US 2007/0140867 A1 Jun. 21, 2007

(51) Int. Cl.
*H02P 1/00* (2006.01)

(52) U.S. Cl. ..... 318/135; 318/687; 417/44.1

(58) Field of Classification Search ..... 318/135, 318/687; 417/44.1
See application file for complete search history.

(56) References Cited

U.S. PATENT DOCUMENTS

| | | | | |
|---|---|---|---|---|
| 5,980,211 | A * | 11/1999 | Tojo et al. | 417/45 |
| 6,176,683 | B1 * | 1/2001 | Yang | 417/44.1 |
| 6,527,519 | B2 | 3/2003 | Hwang et al. | 417/44.11 |
| 2002/0062652 | A1 * | 5/2002 | Hwang et al. | 62/228.3 |
| 2002/0090304 | A1 * | 7/2002 | Yoo et al. | 417/44.1 |
| 2003/0026702 | A1 | 2/2003 | Yoo et al. | 417/44.11 |
| 2003/0177773 | A1 | 9/2003 | Kim | 62/156 |

FOREIGN PATENT DOCUMENTS

| | | |
|---|---|---|
| JP | 2002-354864 | 12/2002 |
| JP | 2003-065244 | 3/2003 |
| JP | 2003-286964 | 10/2003 |
| WO | WO 01/54253 | 7/2001 |

* cited by examiner

*Primary Examiner*—Rina I Duda
(74) *Attorney, Agent, or Firm*—Ked & Associates, LLP

(57) ABSTRACT

A driving controlling apparatus of a linear compressor and a method thereof are disclosed, in which a stroke is variably controlled at the time of a compression processing and a suction processing thus to prevent a consumption power decrease and a refrigerating capacity deficiency phenomenon and to enhance a reliability (v.u). A driving controlling method of a linear compressor, wherein a firing angle is respectively applied at the time of a compression processing and a suction processing according to a load state. The driving controlling apparatus comprises an electric circuit (20) for driving a linear compressor by varying a stroke by a piston movement; a voltage/current detecting unit (21) for detecting a voltage and a current generated at the electric circuit unit (20), a phase difference detecting unit (22) for receiving a voltage and a current from the voltage/current detecting unit (21) and thus detecting a voltage/current phase difference of a corresponding time point; and a stroke controlling unit (23) for receiving a phase difference from the phase difference detecting unit (22) and applying a stroke voltage to the electric circuit unit by differently applying a firing angle at the time of a compression processing and a suction processing, respectively on the basis of the input phase difference.

12 Claims, 6 Drawing Sheets

DRIVING CONTROLLING APPARATUS OF LINEAR COMPRESSOR AND METHOD THEREOF

TECHNICAL FIELD

The present invention relates to a linear compressor, and more particularly, to a driving controlling apparatus of a linear compressor capable of variably controlling a stroke according to a load state and a method thereof.

BACKGROUND ART

In general, a compressor is for enhancing a pressure of refrigerant vapor in order to easily condense refrigerant vapor evaporated from an evaporator. By operation of the compressor, refrigerant repeats condensation and evaporation processes and circulates in a refrigerating device, thereby transmitting heat from a cold part to a warm part.

Among several types of the compressor which are nowadays used, a reciprocating compressor is the most widely used. The reciprocating compressor compresses vapor by a piston which moves up and down in a cylinder thus to enhance a pressure. Since a compression ratio of the reciprocating compressor can be varied by varying a stroke voltage applied to the reciprocating compressor, the reciprocating compressor can be used in controlling a variable refrigerating capacity.

However, since the reciprocating compressor compresses vapor by converting a rotation movement of a motor into a linear movement, a mechanical converting device such as a screw, a chain, a gear system, a timing belt, and etc. for converting a rotation movement into a linear movement is absolutely necessary. According to this, an energy conversion loss is great and a structure of a device becomes complicated. Therefore, recently, a linear compressor using a linear method that a motor itself has a linear movement is being used.

The linear compressor does not require a mechanical conversion device since a motor itself directly generates a linear driving force. In the linear compressor, a structure is not complicated, an energy conversion loss is reduced, and noise can be greatly reduced since a connection portion where friction and abrasion are generated does not exist. Also, in case of applying the linear compressor to a refrigerator or an air conditioner, a compression ratio of the linear compressor can be varied by varying a stoke voltage applied to the linear compressor, so that the linear compressor can be used in controlling a variable refrigerating capacity.

FIG. 1 is a block diagram showing a construction of a driving controlling apparatus of a general linear compressor.

As shown, the driving controlling apparatus of a linear compressor comprises a linear compressor 3 for controlling a refrigerating capacity by varying a stroke (a distance between an upper dead point of and a lower dead point of a piston) by a reciprocation of a piston by a stroke voltage; a current detecting unit 4 for detecting a current applied to the linear compressor 3 by varying a stroke; a voltage detecting unit 5 for detecting a voltage generated at the linear compressor 3 by varying a stroke; a microcomputer 6 for calculating a stroke by using a current and a voltage detected from the current detecting unit 4 and the voltage detecting unit 5, comparing the calculated stroke with a user's input stroke command value, and outputting a switching control signal; and an electric circuit unit 1 for switching an alternating current by a triac 2 by the outputted switching control signal and applying a stroke voltage to the linear compressor 3.

A controlling operation of the conventional linear compressor will be explained as follows.

First, the electric circuit unit 1 outputs a stroke voltage by the user's set stroke command value, and a piston reciprocates by the stroke voltage. Accordingly, a stroke is varied and thus a refrigerating capacity of the linear compressor 3 is controlled. That is, a refrigerating capacity of the linear compressor 3 is controlled in accordance with a stroke is varied by a reciprocation of a piston inside of a cylinder and cooling gas inside of the cylinder is discharged to a condenser through a discharge valve.

When the stroke is varied by a stroke voltage, the current detecting unit 4 and the voltage detecting unit 5 detect a voltage and a current generated at the linear compressor 3 and the microcomputer 6 calculates a stroke by using the detected voltage and current.

According to this, when the calculated stroke is less than a stroke command value, the microcomputer 6 outputs a switching control signal which lengthens an ON period of the triac thus to increase a stroke voltage applied to the linear compressor 3. Also, when the calculated stroke is greater than a stroke command value, the microcomputer 6 outputs a switching control signal which shortens the ON period of the triac thus to decrease a stroke voltage applied to the linear compressor 3.

FIG. 2A is a waveform of an input voltage and an input current in case that a load is less in a driving controlling method of a linear compressor in accordance with the conventional art, and FIG. 2B is a waveform of an input voltage and an input current in case that a load is great in a driving controlling method of a linear compressor in accordance with the conventional art.

As shown in FIGS. 2A and 2B, in the conventional stroke controlling method, a firing angle (current flowing time per alternating current one cycle) according to a load applied to the linear compressor (for example, external air temperature of a refrigerator or a temperature of a condenser) is constant, so that an upper limitation point of a piston inside of a cylinder or a position where a cylinder volume is minimized are changed in accordance with that a load of a refrigerator becomes great or less.

For example, when a load less than a peripheral temperature 30° C. is less (or a load of a middle temperature state), a phenomenon that a position of a piston is changed is scarcely generated. However, when a load more than a peripheral temperature 40° C. is great (or a load of a high temperature state), a stroke is controlled by a constant firing angle (or the same input state). Accordingly, a movement distance of a piston is relatively increased in a suction processing than in a compression processing thus to generate a phenomenon that a piston is pushed backwardly, thereby generating abrasion and collision of a piston.

According to this, at the time of driving the conventional linear compressor, a phenomenon of a refrigerating capacity deficiency is generated or efficiency is lowered thus to degrade a reliability.

DISCLOSURE OF THE INVENTION

Therefore, it is an object of the present invention to provide a driving controlling apparatus of a linear compressor capable of preventing a power consumption decrease and a refrigerating capacity deficiency phenomenon and capable of enhancing a reliability at the time of a compressor driving by variably controlling a stroke at the time of a compression processing and a suction processing according to a load state and a method thereof.

To achieve these objects, there is provided a driving controlling apparatus of a linear compressor comprising: an electric circuit unit for driving a linear compressor by varying a stroke by a piston movement; a voltage/current detecting unit for detecting a voltage and a current generated at the electric circuit unit; a phase difference detecting unit for receiving a voltage and a current from the voltage/current detecting unit and thus detecting a voltage/current phase difference of a corresponding time point; and a stroke controlling unit for receiving a phase difference from the phase difference detecting unit and applying a stroke voltage to the electric circuit unit by differently applying a firing angle at the time of a compression processing and a suction processing, respectively on the basis of the inputted phase difference.

To achieve these objects, there is also provided a driving controlling method of a linear compressor that is applying a firing angle at the time of a compression processing and a suction processing, respectively according to a load state.

MODES FOR CARRYING OUT THE PREFERRED EMBODIMENTS

Figure 1:
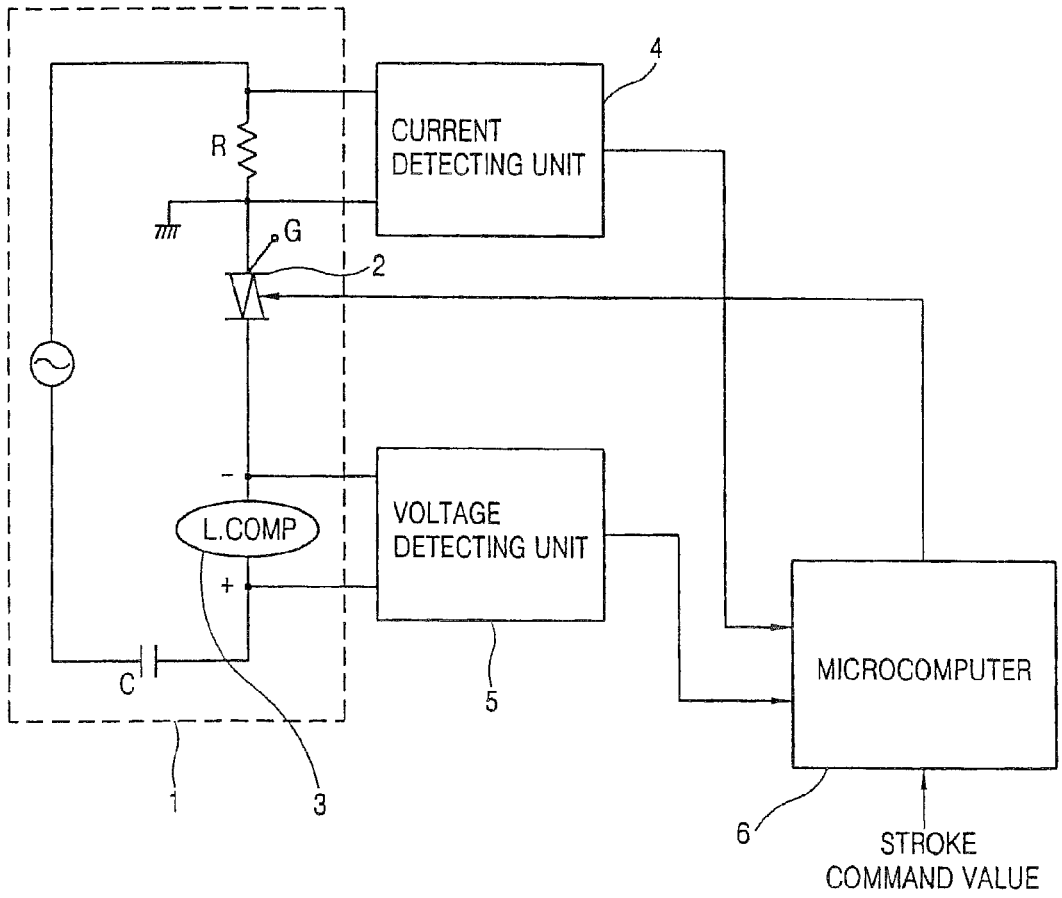
FIG. 1 CONVENTIONAL ART
FIG. 1 is a block diagram showing a construction of a driving controlling apparatus of a linear compressor in accordance with the conventional art.
Figure 2A:
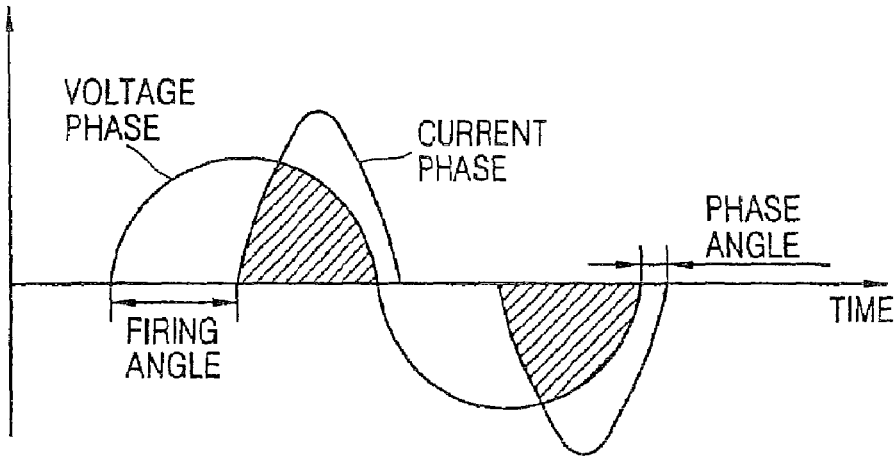
FIG. 2A CONVENTIONAL ART
FIG. 2A is a waveform of an input voltage and an input current in case that a load is less in a driving controlling method of a linear compressor in accordance with the conventional art.
Figure 2B:
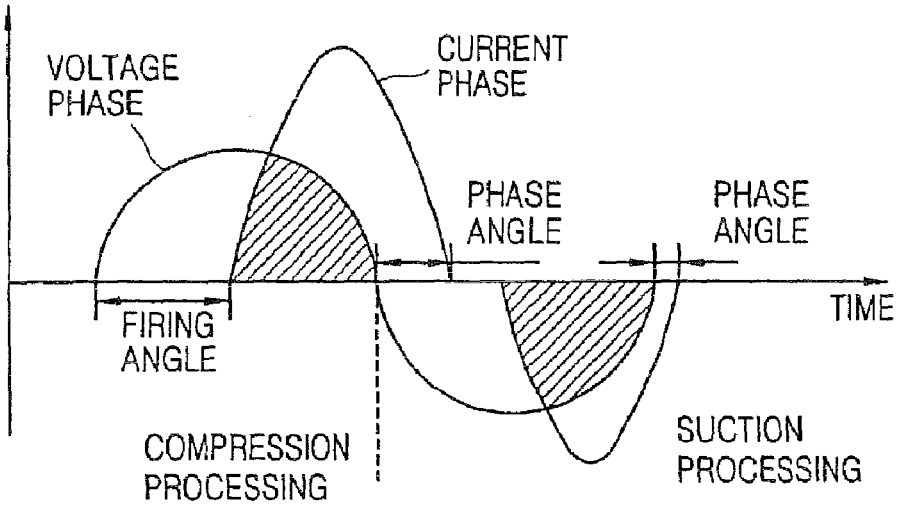
FIG. 2B CONVENTIONAL ART
FIG. 2B is a waveform of an input voltage and an input current in case that a load is great in a driving controlling method of a linear compressor in accordance with the conventional art.
Figure 3:
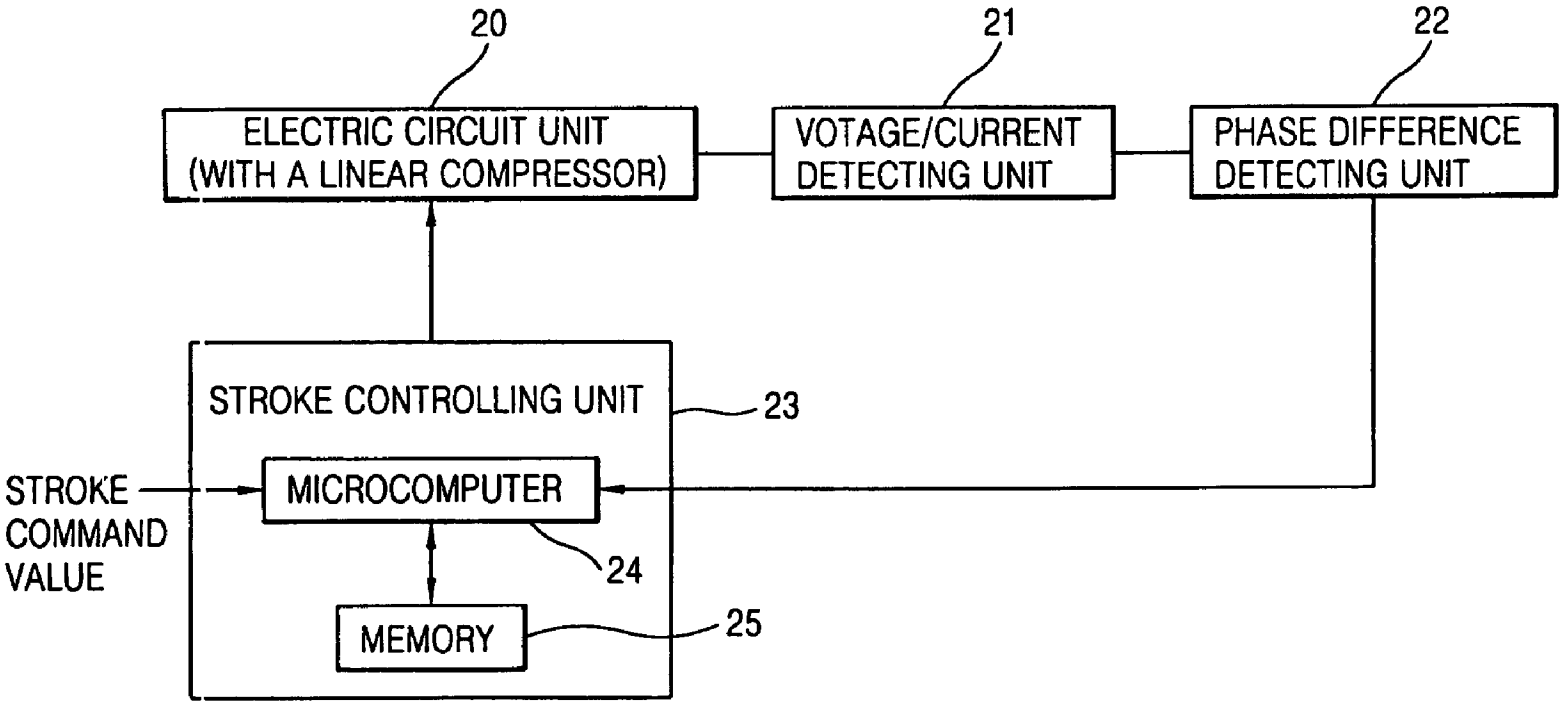
FIG. 3 is a block diagram showing a construction of a driving controlling apparatus of a linear compressor according to the present invention.

FIG. 3 is a block diagram showing a construction of a driving controlling apparatus of a linear compressor according to the present invention.

As shown in FIG. 3, the driving controlling apparatus of a linear compressor according to the present invention comprises: an electric circuit unit 20 for driving a linear compressor by varying a stroke by a piston movement; a voltage/current detecting unit 21 for detecting a voltage and a current generated at the electric circuit unit 20; a phase difference detecting unit 22 for receiving a voltage and a current from the voltage/current detecting unit 21 and thus detecting a voltage/current phase difference of a corresponding time point; and a stroke controlling unit 23 for receiving a phase difference from the phase difference detecting unit 22 and applying a stroke voltage to the electric circuit unit by differently applying a firing angle at the time of a compression processing and a suction processing, respectively on the basis of the inputted phase difference.

The stroke controlling unit 23 comprises a microcomputer 24 for comparing a voltage/current phase difference detected from the phase difference detecting unit 22 with a voltage/current phase difference at the time of a standard load, thereby differently applying a firing angle at the time of the compression processing and the suction processing, respectively, and thus outputting a switching control signal according to the stroke voltage; and a memory 25 for previously storing a stroke voltage value corresponding to a voltage/current phase difference.

Also, the electric circuit unit 20 receives a switching control signal from the microcomputer and switches an alternating current to a triac (not shown), thereby driving the linear compressor.

Figure 4:
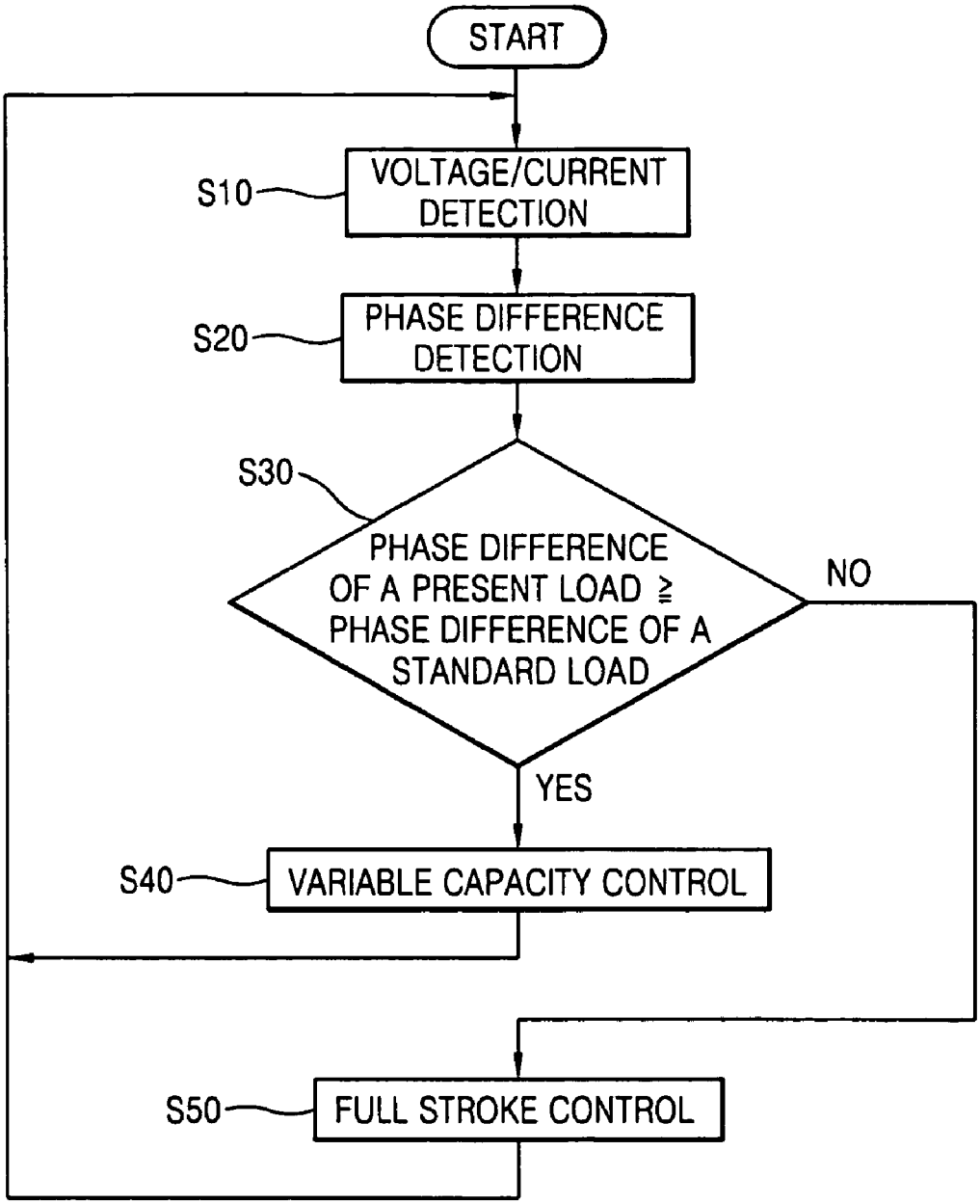
FIG. 4 is a flow chart showing a driving controlling method of a linear compressor according to the present invention.

FIG. 4 is a flow chart showing a driving controlling method of a linear compressor according to the present invention.

Referring to FIG. 4, operation of the driving controlling apparatus of a linear compressor will be explained as follows.

First, as a stroke is varied by a stroke voltage, the voltage/current detecting unit 21 detects a voltage and a current generated at the linear compressor and thus applies the detected voltage and current to the phase difference detecting unit 22 (S10). Accordingly, the phase difference detecting unit 22 receives the voltage and current detected from the voltage/current detecting unit 21 and thereby detects a voltage/current phase difference of a corresponding time point (S20).

Then, the stroke controlling unit 23 receives a voltage/current phase difference of a present load state from the phase difference detecting unit 22 and compares it with a voltage/current phase difference at the time of a standard load (S30). According to this, when a voltage/current phase difference of a present load state is more than the voltage/current phase difference at the time of a stand load, a stroke is controlled by a variable capacity control method for varying a stroke (S40). Also, when a voltage/current phase difference of a present load state is less than the voltage/current phase difference at the time of a stand load, the linear compressor is controlled by a decreasing stroke (S50).

A stroke controlling method at the time of the variable capacity control will be explained with reference to FIGS. 5 and 6 as follows.

Figure 5:
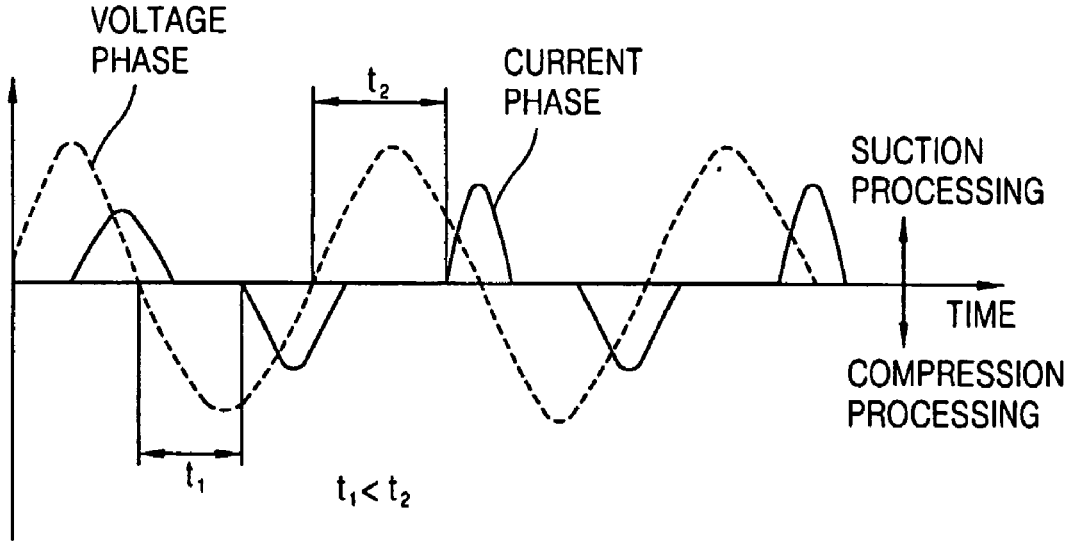
FIG. 5 is a waveform showing a voltage and a current for a suction process and a compression process at the time of a variable capacity control.
Figure 6:
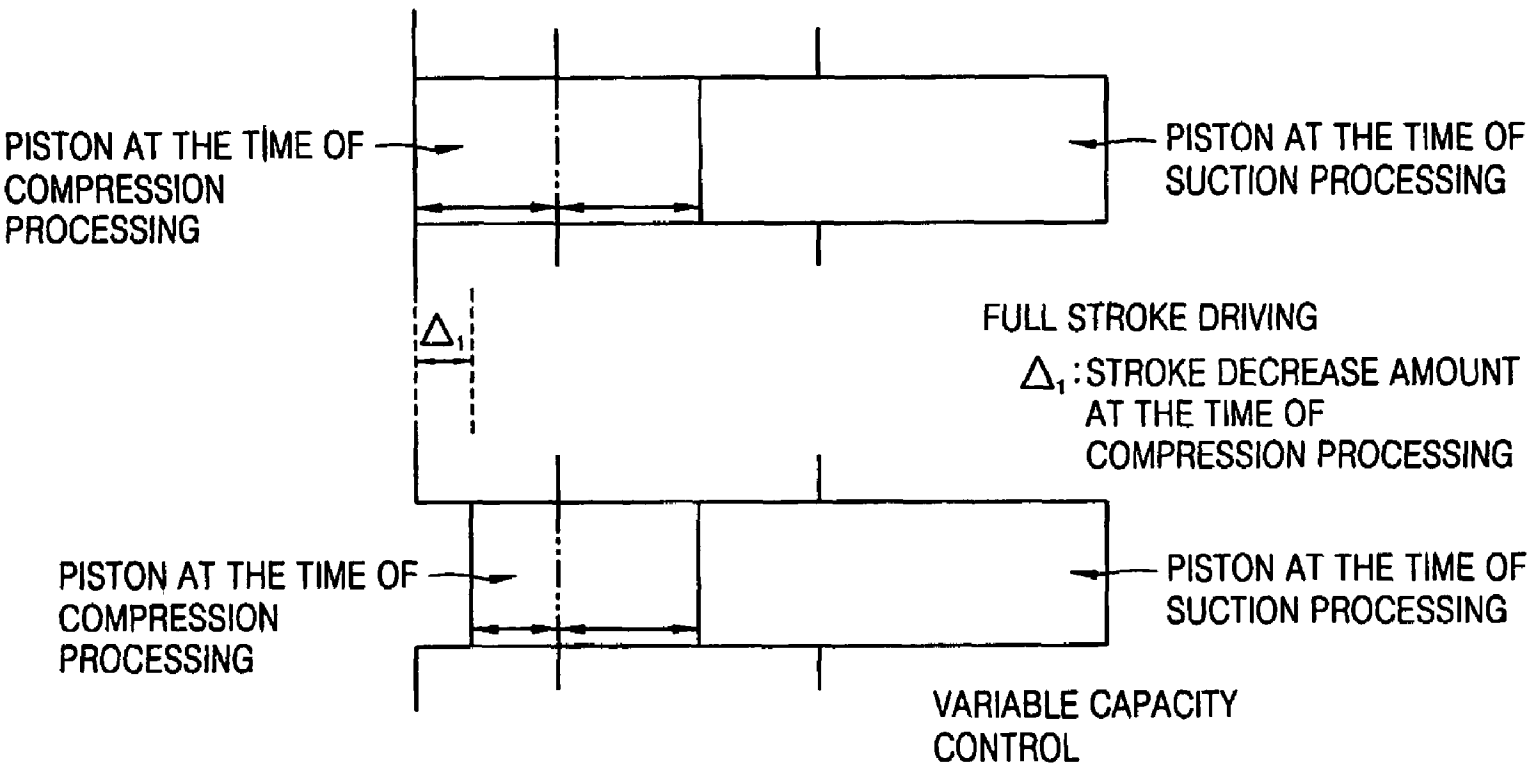
FIG. 6 is an exemplary view showing a stroke at the time of a full stroke control and a variable capacity control according to the present invention.

FIG. 5 is a waveform showing a voltage and a current for a suction process and a compression process at the time of a variable capacity control, and FIG. 6 is an exemplary view showing a stroke at the time of a full stroke control and a variable capacity control according to the present invention.

First, a main spring and a refrigerant gas spring are used at the time of a compression processing, and a main spring is used at the time of a suction processing. At this time, if the user set a stroke command value of the compressor, a stroke value has to be constantly maintained regardless of a size of a load in order to efficiently drive the compressor. However, when a load is too great or less at the time of driving the compressor, a reliability of a stroke control is degraded due to a load variance. That is, the compressor can be trembled as a piston is pushed or collides.

To overcome this, the stroke controlling unit of the present invention controls a refrigerating capacity in a predetermined range where the maximum efficiency of a stroke in a cycle of piston operation by controlling a stroke up and down (that is, a variable capacity control).

That is, as shown in FIG. 5, the suction processing or the compression processing are determined on the basis of a maximum value of a current and a phase difference variance. As a result of the determination, at the time of the compression processing, a firing angle is decreased in order to decrease a stroke, and at the time of the suction processing, a firing angle is maintained in order to maintain the full stroke having a maximum distance between an upper dead point and a lower dead point of a piston.

Also, as shown in FIG. 6, at the time of the compression processing, the stroke controlling unit applies a stroke voltage for increasing a stroke to the electric circuit unit, thereby preventing the piston from being pushed backwardly, and at the time of the suction processing, the stroke controlling unit applies a stroke voltage for controlling by a full stroke having a maximum distance between an upper dead point and a lower dead point of a piston to the electric circuit unit thus to enhance a compressor efficiency.

As aforementioned, in the present invention, a firing angle is differently applied at the time of the compression processing and the suction processing, respectively. According to this, a piston inside of a cylinder moves by a corresponding stroke voltage and thereby a stroke is varied, thereby controlling a refrigerating capacity. That is, in order to differently control a stroke at the time of the compression processing and the suction processing of the linear compressor according to a load state, a current phase is controlled asymmetrically, thereby preventing a piston from being pushed backward at the time of the suction processing.

In the present invention, a firing angle is differently applied at the time of the compression processing and the suction processing, respectively. According to this, the piston inside of the cylinder moves by a corresponding stroke voltage and thereby a stroke is varied, thereby controlling a refrigerating capacity. Accordingly, a power consumption decrease and a refrigerating capacity deficiency phenomenon can be prevented and a reliability can be enhanced.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A driving control method for a linear compressor, the method comprising:

determining when the compressor is compression processing and suction processing based on a maximum value of a current and a phase angle variance; and applying an appropriate firing angle during compression processing and during suction processing, respectively, based on a detected load state.

2. The method of claim 1, further comprising varying a stroke during compression processing, and performing full stroke control having a maximum distance between an upper dead point and a lower dead point of a piston during suction processing during a high temperature load operation.

3. The method of claim 1, further comprising decreasing a firing angle so as to increase a stroke during compression processing in high temperature load operation.

4. The method of claim 1, further comprising:

detecting a load of the linear compressor;

comparing the detected load to a standard load;

performing variable capacity control and varying a stroke when the detected load is greater than the standard load; and performing full stroke control having a maximum distance between an upper dead point and a lower dead point of a piston when the detected load is less than the standard load.

5. The method of claim 4, wherein performing variable capacity control further comprises determining when the compressor is suction processing and compression processing based on a maximum value of a current and a phase angle variance, and decreasing a firing angle so as to increase a stroke during compression processing.

6. A driving control method for a linear compressor, the method comprising:

detecting a voltage and a current generated at a linear compressor;

determining a present voltage/current phase difference based on the detected voltage and current;

comparing the present voltage/current phase difference with a standard voltage/current phase difference; and performing variable capacity stroke control and varying a stroke when the present voltage/current phase difference is greater than the standard voltage/current phase difference, and decreasing a stroke when the present voltage/current phase difference is less than the standard voltage/current phase difference.

7. The method of claim 6, wherein performing variable capacity stroke control comprises:

determining whether the compressor is compression processing or suction processing by detecting a maximum value of a current and a phase difference variance; and decreasing a firing angle so as to increase a stroke during compression processing, and maintaining a firing angle so as to maintain a full stroke having a maximum distance between an upper dead point and a lower dead point of a piston during suction processing based on the determination.

8. A driving control apparatus of a linear compressor, the apparatus comprising:

an electric circuit that drives a linear compressor by varying a stroke and a corresponding piston movement;

a voltage/current detector that detects a voltage and a current generated by the electric circuit;

a phase difference detector that receives a voltage and a current from the voltage/current detector and detects a voltage/current phase difference at a corresponding point in time; and a stroke controller that receives a phase difference from the phase difference detector and applies a stroke voltage to the electric circuit based on the received phase difference, wherein the stroke controller applies a different firing angle during compression processing than that applied during suction processing based on the received phase difference.

9. The apparatus of claim 8, wherein the stroke controller applies a stroke voltage that increases a stroke to the electric circuit during compression processing, and applies a stroke voltage corresponding to full stroke control having a maximum distance between an upper dead point and a lower dead point of a piston to the electric circuit during suction processing.

10. The apparatus of claim 8, wherein the stroke controller comprises:

a microcomputer that compares a present voltage/current phase difference detected by the phase difference detector with a standard voltage/current phase difference and applies a different firing angle during compression processing than that applied during suction processing based on the comparison, and outputs a switching control signal based on the stroke voltage; and a memory that receives and stores a stroke voltage value corresponding to a voltage/current phase difference.

11. The apparatus of claim 10, wherein the stroke controller performs variable capacity stroke control to vary a stroke when a present voltage/current phase difference is greater than the standard voltage/current phase difference, and decreases a stroke when a present voltage/current phase difference is less than the standard voltage/current phase difference.

12. The apparatus of claim 8, wherein the electric circuit switches an alternating current to a triac to drive the linear compressor.

* * * * *